United States Patent [19]

Berfield

[11] Patent Number: 4,475,265

[45] Date of Patent: Oct. 9, 1984

[54] SHOE ATTACHMENT FOR WET/DRY ELECTRIC VACUUM CLEANER

[75] Inventor: Robert C. Berfield, Jersey Shore, Pa.

[73] Assignee: Shop-Vac Corporation, Williamsport, Pa.

[21] Appl. No.: 503,683

[22] Filed: Jun. 13, 1983

[51] Int. Cl.[3] ..... A47L 9/02

[52] U.S. Cl. ..... 15/414; 15/401; 15/415 R

[58] Field of Search ..... 15/320, 321, 322, 401, 15/414, 415 R

[56] References Cited

U.S. PATENT DOCUMENTS

| | | | |
|---|---|---|---|
| 2,349,371 | 5/1944 | Patterson | 15/401 |
| 2,893,046 | 7/1959 | Thompson | 15/401 X |
| 3,072,951 | 1/1963 | Kelnhofer | 15/401 X |
| 3,079,623 | 3/1963 | Congdon | 15/401 X |
| 3,871,051 | 3/1975 | Collier | 15/321 |
| 3,958,298 | 5/1976 | Cannan | 15/322 |
| 4,095,309 | 6/1978 | Sundheim | 15/321 X |
| 4,334,337 | 6/1982 | Miller et al. | 15/353 X |

*Primary Examiner*—Chris K. Moore

*Attorney, Agent, or Firm*—Ostrolenk, Faber, Gerb & Soffen

[57] ABSTRACT

An integral, one piece shoe attachment for detachable insertion in the intake orifice of an electric vacuum cleaner. The bottom surface of the shoe attachment has rounded projections which raise the shoe attachment bottom surface slightly off the surface being suctioned. A flexible blade extends along the long dimension of the inlet opening and divides the inlet opening into a front and rear section. The blade projects down far enough that as the shoe attachment is moved in one direction, the blade flexes to close off one section of the inlet opening, and as the shoe attachment is moved in the opposite direction, the blade flexes in the opposite direction to close off the other section of the inlet opening.

8 Claims, 7 Drawing Figures

SHOE ATTACHMENT FOR WET/DRY ELECTRIC VACUUM CLEANER

BACKGROUND OF THE INVENTION

The invention concerns a wet/dry vacuum cleaner and in particular a shoe attachment for the intake of a vacuum cleaner which is suitable for picking up dry materials, wet materials and even liquids. The invention is useful for the intake of an upright type electric vacuum cleaner and for the intake nozzle of a cannister type vacuum cleaner.

An electric vacuum cleaner generally includes suction generating apparatus, such as a suction fan, which communicates with an intake orifice. To increase suction force at the intake orifice, the orifice is typically of reduced width across at least one dimension, and the reduced size of the orifice increases the speed of air flow through the orifice.

An electric vacuum cleaner may be of the type where the intake orifice is at the front of the underside of a housing that rides along the surface to be suctioned, or it may be of the type having an intake hose with the intake orifice in the nozzle at the end of the hose. The present invention is useful in conjunction with both types of vacuum cleaners.

Furthermore, some vacuum cleaners are known as wet/dry types, in that they are adapted to suction dry particulate materials, wet or damp materials and even liquids. Dry particulate materials are lighter in weight and thus can be suctioned using a smaller suction force. But wet materials and liquids in particular require a relatively greater suction force to be suctioned. In some circumstances, a vacuum cleaner with an intake suction force only great enough to take in dry particulate materials may not have adequate suction force for taking in wet particulate materials or liquids.

It is known to apply a shoe to the inlet of a vacuum cleaner for various purposes, including reducing the size of the inlet opening when higher suction force is needed, and to remove the shoe to enlarge the inlet opening when lower suction force is needed. See U.S. Pat. Nos. 3,958,298; 2,349,371; 3,871,051; and Application Ser. No. 320,721, filed Nov. 12, 1981, now U.S. Pat. No. 4,413,372, by the inventor hereof, and assigned to the assignee hereof.

To sweep material into the inlet opening of the shoe, a blade supported on the vacuum cleaner or on the shoe, but always a separate element from the shoe, is disposed across the shoe at its inlet and pushes material toward the inlet opening as the shoe is moved. The blade is at the middle of the inlet opening, front-to-back, so that it sweeps material to that side of the inlet opening leading the motion of the blade. The separateness of the blade from the shoe requires separate fabrication of and then securement of the blade to the shoe for enabling the blade to move, and this produces an undesirably complicated shoe.

The blade is known to be attached in the shoe or in the nozzle or intake opening that receives the shoe in various ways. These include a swivel hinge in the shoe on which the blade swivels as the nozzle is moved forward and rearward, the blade being captured in a shaped slot in the shoe to permit the blade to swivel as the nozzle is moved, and a flexible blade which flops back and forth with respect to the rigid nozzle to which the blade is affixed. But all of these blades are separate from the shoe, with the drawbacks noted above.

SUMMARY OF THE INVENTION

Accordingly, it is the primary object of the present invention to provide adequate suction force at the intake of a vacuum cleaner.

It is another object of the present invention to enable an electric vacuum cleaner to effectively suction wet material or liquid.

It is yet another object of the invention to selectively increase the speed of air flow and/or the suction force at the intake of the vacuum cleaner.

It is yet a further object of the invention to sweep liquid toward the intake orifice to be suctioned.

It is a further object of the invention to accomplish the foregoing objects with an electric vacuum cleaner of the type wherein the intake orifice rides over the surface to be suctioned.

The present invention may be used in connection with an electric vacuum cleaner intake orifice at the underside of the vacuum cleaner housing or with an intake orifice in a nozzle at the end of a hose. In either case, the orifice rides above the surface to be suctioned. The intake orifice is normally relatively wide, side-to-side, with respect to the forward and backward directions of the normal pathway of movement of the vacuum cleaner and is relatively narrow in the front-to-back dimension along the path of movement of the vacuum cleaner during use. The relatively wide side-to-side but narrow front-to-back orifice is narrow enough to produce an adequate air flow speed and/or suction force at the intake orifice for at least picking up dry materials.

According to the present invention, an integral, one piece shoe attachment having an inlet opening adapted for easing the pickup of wet materials in general and liquid in particular is removably emplaced or inserted in the intake orifice of the vacuum cleaner. The shoe attachment includes a bottom surface that rides slightly above the surface being suctioned. The shoe attachment is comprised of a flexible plastic resin material.

The shoe attachment surrounds the entire intake orifice and has an inlet opening through it, thereby defining a smaller cross-section inlet opening for the vacuum cleaner. The inlet opening through the shoe attachment has a side-to-side width that is generally the width of the intake orifice of the vacuum cleaner. But the inlet opening is generally narrower in the front-to-back dimension than the intake orifice. This increases the speed of air flow and/or the suction force at the inlet opening through the shoe attachment. The increased air flow and/or suction force aids in sucking in liquids from the surface being suctioned.

There is an additional flexible, resilient blade of the same material as and integral and one piece with the rest of the shoe attachment, which extends across the width, side-to-side, of the inlet opening and is generally centered so as to approximately bisect the inlet opening front-to-back where the blade projects out of that opening. The blade projects out from the inlet opening beyond the bottom surface of the shoe attachment and the blade contacts the surface to be suctioned, so that as the shoe attachment is moved forwardly and rearwardly over the surface being suctioned, the blade folds over against the bottom surface of the shoe attachment and blocks inlet to the side of the inlet opening which trails the direction in which the blade is then moving. Additionally, the blade pushes before itself the material that is in front of the blade in the direction in which the blade is moving. This directs material to the then unblocked side of the inlet opening to be suctioned there. As the direction of movement of the shoe attachment alternates, the blade is pulled from its folded over condition over one side of the inlet opening and is pulled over center to be pushed to its folded over condition over the other side of the inlet opening. The flexibility of the blade and the friction between the blade and the surface being suctioned enables the blade to flop back and forth as the vacuum cleaner is moved forwardly and rearwardly.

To aid in the folding of the blade and to enable the nozzle in which the shoe attachment is placed to rock normally in use, the underside of the shoe attachment carries a projection, or more typically, two projections spaced apart along the long of dimension of the inlet opening which slightly raise the inlet opening and help control blade folding. The projections are rounded around the side-to-side axis to enable the nozzle to rock in use.

Other objects and features of the present invention will become apparent from the following description of a preferred embodiment of the invention taken in conjunction with the accompanying drawings.

DESCRIPTION OF THE PREFERRED EMBODIMENT

Figures 1, 2, 3:
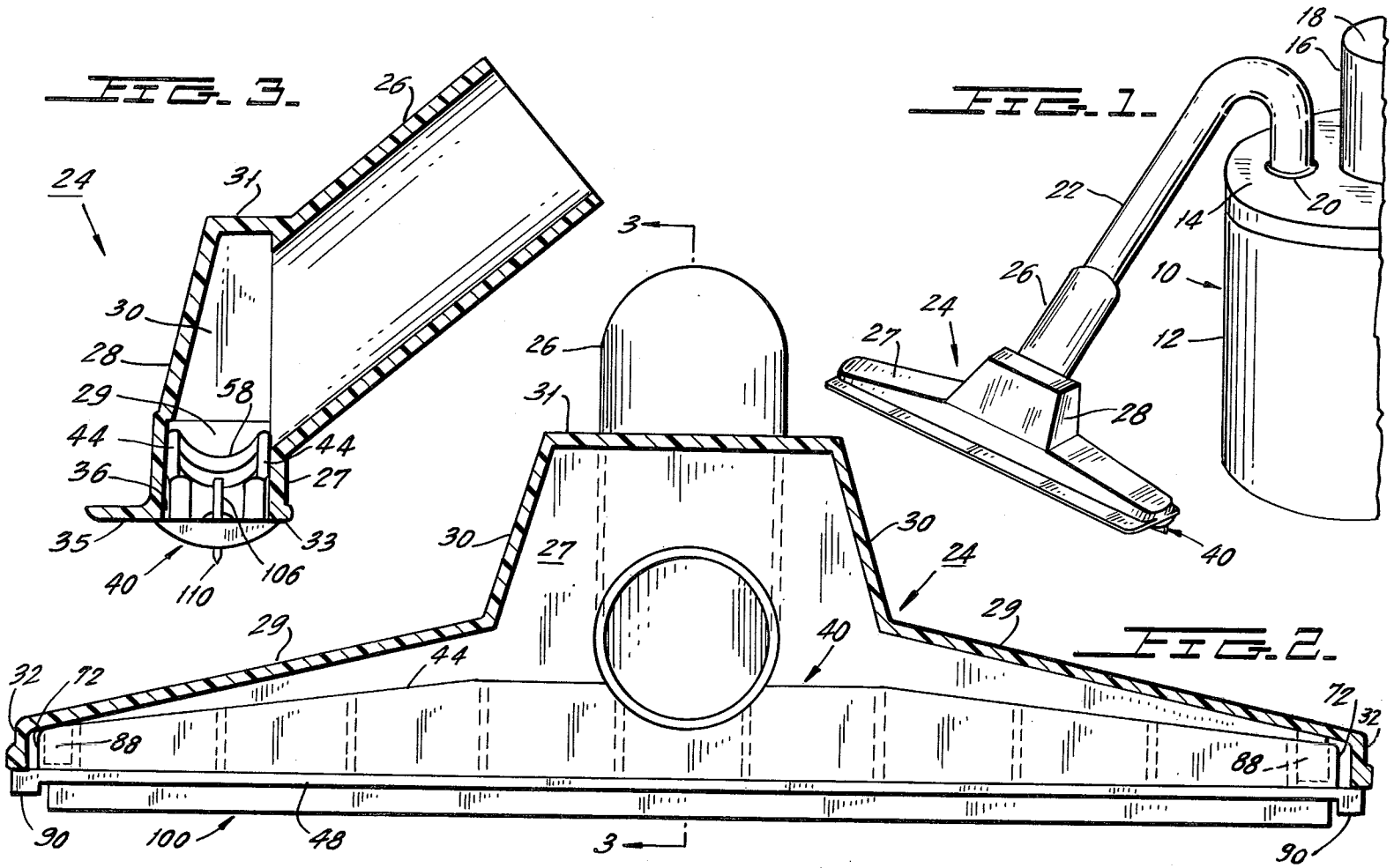
FIG. 1 is a perspective view of an electric vacuum cleaner having an intake nozzle adapted with the shoe attachment of the invention for use at the inlet opening to the nozzle.
FIG. 2 is a front elevational view of an intake nozzle of the type used with the vacuum cleaner of FIG. 1, with the front of the nozzle removed and showing the shoe attachment installed therein.
FIG. 3 is a cross-sectional view of the nozzle shown in FIG. 2, in the direction and along the line of arrows 3 in FIG. 2.
Figure 4:
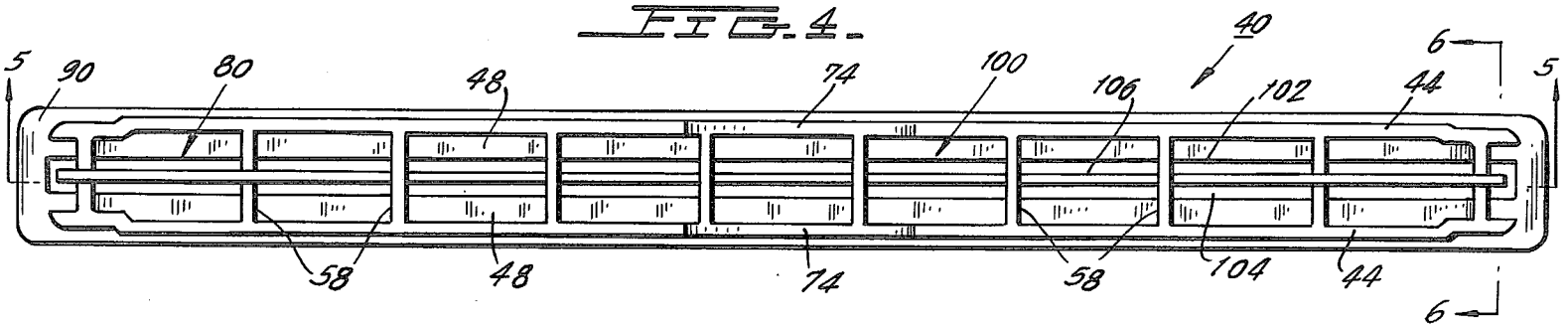
FIG. 4 is a top view of the shoe attachment of the invention.

The shoe attachment 40 is described in connection with an electric vacuum cleaner 10, commonly referred to as a cannister or tank vacuum cleaner, which includes a suctioned material collecting tank 12, a lid 14 over the top of the tank, a suction force generating blow motor supported at 16 on the lid, and having an air outlet 18, and an inlet 20 into the lid, or into the side wall of the tank if desired, for inflow of air suctioned by the blow motor at 16. At the inlet 20 there is a fitting which receives a flexible, elongate hose 22 which extends to a rigid nozzle 24 that is attached at the end of the hose.

The nozzle 24 is a hollow plastic unit, including the hose fitting 26 at its rear which receives the end of the hose 22, a rear wall 27 which closes off the rear of the housing, an opposite front wall 28, a stepped, inclined top wall 29, 30, 31, which closes off the top of the nozzle 24, and opposite lateral side walls 32. The sections 29 and 30 of the nozzle top wall incline downwardly and outwardly away from the hose fitting 26 to decrease the cross-sectional area of the nozzle moving away from the fitting 26. A smaller cross-sectional area for air to move through causes the air to move more rapidly than a larger cross-sectional area, whereby the flow of air suctioned into the hose fitting 26 will be more uniform across the full width of the nozzle between its opposite lateral side walls 32. There is a short, rear lip 33 at the rear and bottom of the nozzle 24 and a longer, forwardly projecting front plate 35. Both of these extend across the width of the nozzle. These help maintain the nozzle at a desired orientation, especially when the shoe attachment 40 is absent from the nozzle, so that the intake opening to the nozzle is close enough to the surface being suctioned to assure adequate suction force. The underside of the plate 35 is ridged as at 34 for providing an air pathway into the opening 36 into the nozzle between the ridges, even with the nozzle tilted so that the plate 35 is against the surface being suctioned.

Through an opening 36 across the bottom of the nozzle, air enters the open plenum of the nozzle and communicates with the hose fitting 26. The opening 36 extends between the side walls 32 and between the front and rear walls 27, 28 of the nozzle. The inlet opening 36 is quite large, and air sucked through the inlet opening will move at a relatively slower velocity, which might be sufficient for picking up dry particulate materials, but would not suffice for wet materials and especially liquid. Therefore, the shoe attachment 40 may be employed to assure that sufficient suction is generated at the intake to the nozzle 24 for suctioning wet materials and liquid.

The shoe attachment 40 is comprised of a single piece of plastic and particularly a thermoplastic elastomer. One example of such an elastomer is Uniroyal TPR-1700R. This resin has the characteristic that it is resilient, in that it tends to restore itself to its original shape if deformed, and it is sufficiently flexible and deformable that the blade 100 integrated into the shoe attachment can fold to its different positions during movement of the vacuum cleaner nozzle. The inherent flexibility of the shoe attachment 40 also permits it to be removably inserted into the intake opening 36 of the nozzle 24.

Figure 5:
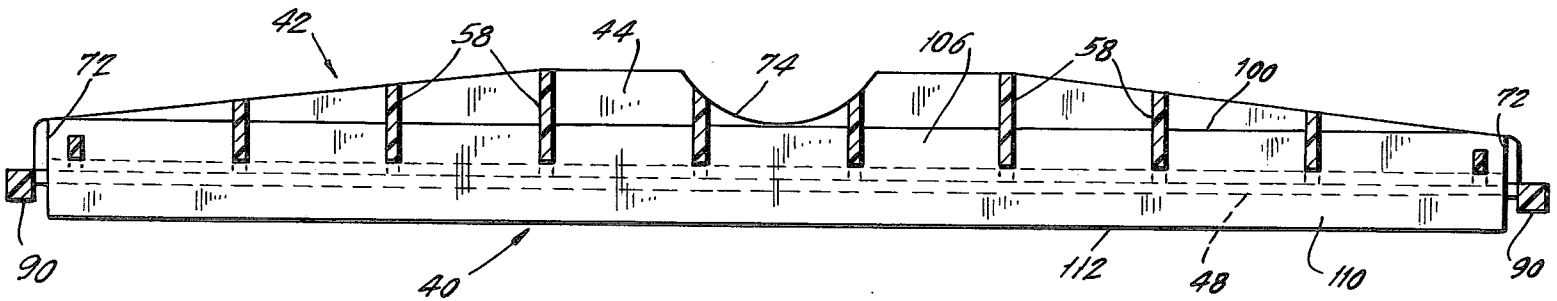
FIG. 5 is a front, elevational, cross-sectional view of that shoe attachment along the line and in the direction of arrows 5 in FIG. 4.
Figure 6:
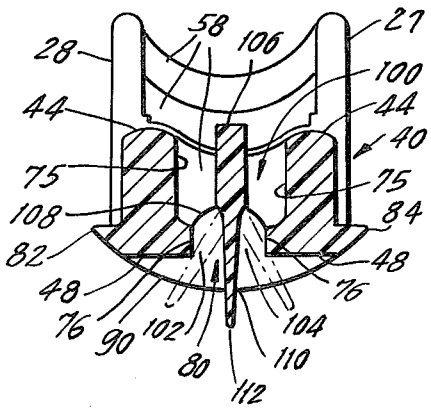
FIG. 6 is a side, cross-sectional view of the shoe attachment along the line and in the direction of arrows 6 in FIG. 4.
Figure 7:
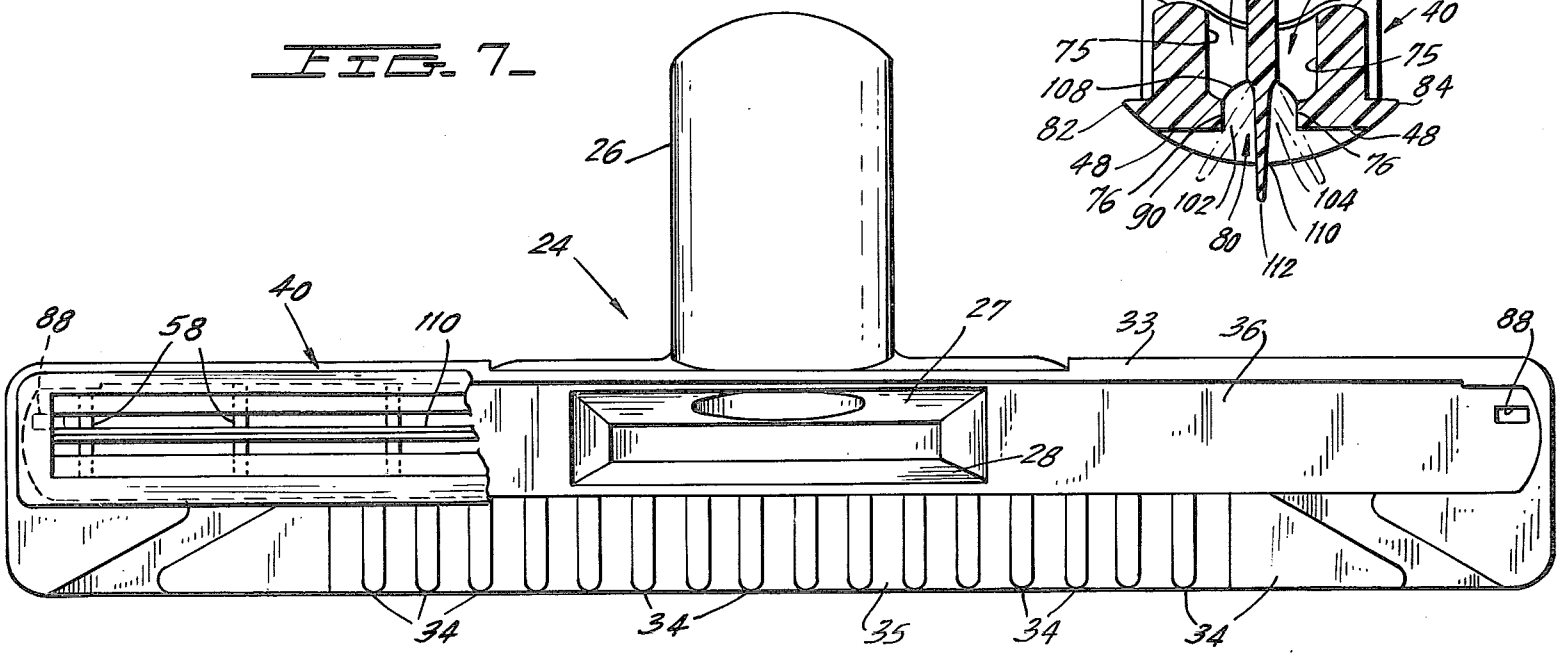
FIG. 7 is a bottom view of the nozzle of FIGS. 2 and 3.

The shoe attachment 40 comprises an upstanding insertion portion 42 comprised of opposite, spaced apart, upstanding, widthwise elongate, front and rear walls 44, which extend to the respective lateral side edges 72 of those walls. As can be seen in FIGS. 2 and 5, the tops of the walls 44 are inclined so as to be able to fit under the top wall 29 of the nozzle with some clearance, and they include the central rounded depression 74 located at the hose fitting 26 so as to not block air flow into that fitting. As shown in FIG. 6, the internal surfaces 75 of the walls 44 are relatively more widely spaced apart.

The walls 44 of the shoe attachment 40 are adapted for firm, but removable, attachment in the inlet opening 36 of the nozzle 24. No snap lock tabs, or the like, are provided for holding the shoe attachment in the nozzle. Instead, the walls 44 are sufficiently resilient and have sufficient outward bias that they press against the adjacent opposed surfaces of the front wall 27 and rear wall 28 of the nozzle for providing frictional engagement therebetween, which retains the shoe attachment in the opening. In addition, the underside of the top wall 30 of the nozzle carries a respective downward projection 88, which extends into the space between one of the shoe attachment walls 44 and the flexible blade 100, described below, and this also provides a frictional connection between the shoe attachment and the nozzle which holds them separably together.

At the bottoms of the internal surfaces 75 of the walls 44, there are inwardly projecting lips 76, which define a narrower width inlet opening 80 which extends across the width of the shoe attachment 40. The lips 76 are shaped and have a thickness front-to-back selected so that the resulting inlet opening 80 has the desired front-to-back width dimension for producing a selected air flow rate and/or suction force at the inlet opening 80. The shoe attachment 40 also includes the flat, undersurface 48 on the underside of the walls 44, and this undersurface 48 extends both forwardly and rearwardly of the inlet opening 80 and beneath the walls 44. The undersurface 48 is slightly upraised off the surface to be suctioned, by the projection supports 90 on the underside of the shoe attachment, as described below. On both the forward side and the rearward side of the walls 44, respective forwardly and rearwardly projecting lips 82, 84 are provided. These extend beneath the front plate 35 and the rear lip 33, respectively, of the nozzle 24, for establishing the fully inserted position of the shoe attachment.

The upstanding walls 44 are also joined by a plurality of connectors 58 which are at spaced apart intervals along the width of the shoe attachment. These connectors support and position the walls with respect to each other and also position, orient and provide support for the below-described flexing blade 100. The undersurface 48 of the shoe attachment terminates at the ends of the shoe attachment in two convex, circle segment surfaced projections 90 which define the lateral, widthwise ends of the shoe attachment, and support the shoe attachment. The projections 90 are rounded around the elongate widthwise axis of the nozzle. The shape and size of the projections 90 are selected to slightly raise the undersurface 48 of the shoe attachment. The surfaces of projections 90 are curved so that as the nozzle is manually moved back and forth by an operator during use, the normal back and forth rocking which the nozzle will experience will occur around the curved surfaces 90, and the front and rear edges of the nozzle will not necessarily dig into the surface being suctioned, but will instead be able to rock, as desired. Furthermore, with the nozzle rocked rearwardly, for example, the front of the nozzle will be upraised, providing a slot to the front of the nozzle which communicates to the inlet opening 80. Correspondingly, with the nozzle rocked forwardly, and thus with the plate 35 inclined toward the surface being suctioned, a slot is opened from the rear of the nozzle to the inlet opening 80.

At approximately the middle, front-to-back, of the inlet opening 80, an elongate blade 100 is integrally supported to extend across the entire width of the inlet opening, defining thereby a front half 102 of the inlet opening 80 and a rear half 104 of the inlet opening 80, respectively, to the front of and to the rear of the blade 100. The blade 100 includes a thicker, rigid supporting portion 106 which is integrated into the middle of each of the connectors 58. Projecting beneath the connectors 58, and particularly beneath the curved bottom end 108 thereof, is the normally straight, downwardly projecting flexible blade 110. As shown in phantom in FIG. 6, the blade 110 is adapted to flex and fold against the lips 76 at the front and rear wall 44. The blade extends to its bottom end 112 which extends flat, straight across the blade, and the blade 110 is of a length that its end 112 extends below the bottom of the curved surfaces of the projections 90 at the ends of the shoe attachment. When the nozzle is moved forward, to the left in FIG. 6, the blade 110, 112 is forced rearwardly, contacts the lip 76 at the rear one of the walls 44 and blocks the rear section 104 of the opening, leaving open only the front section 102 of the inlet opening. That front section is relatively narrow and the entrance of air and suctioned material through that narrowed section 102 occurs. As the nozzle is tilted further rearwardly around the surface 90, the blade 110 still maintains the rear section 104 closed. When the direction of movement of the nozzle 24 is reversed to the rear, the blade 110, with its edge 112 at the surface 90, is pulled forwardly by the frictional engagement between its end 112 and the surface being suctioned and the blade 110 pivots to the front position, now blocking the front section 102 of the inlet opening 80, while opening the rear section 104 thereof. This flexing and shifting of the blade 110 repeats as the nozzle is moved forwardly and rearwardly.

Once the air is sucked into either inlet opening section 102 or 104, it moves into the plenum of the nozzle and through the fitting 26 into the hose 22 and eventually into the vacuum cleaner 10. While the shoe attachment 40 of this embodiment is shown in use in a nozzle connected with a hose, this shoe attachment could be used in the intake to an electric vacuum cleaner housing of the type that sits on the surface being suctioned. If desired, in that situation, the shape of the projection 90 might be altered, since the pivoting which the nozzle 24 experiences during use would not likely occur in a vacuum cleaner having a larger bottom surface of the housing.

With the shoe attachment of the invention installed, the narrowed inlet opening increases the suction force and enables heavy particulate material, e.g. wet particulate materials, and even liquids to be readily sucked into the vacuum cleaner. With the shoe attachment removed, there is weaker suction force to pick up dry particulate materials and there may be adequate suction for picking up other materials, as well.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A shoe attchment for the intake of a suction device, like a vacuum cleaner, or the like, wherein the suction device includes an intake conduit, means for supplying suction force to the intake conduit, and the intake conduit having an end having an intake orifice defined in it into which material is sucked by the suction force; means communicating with the intake conduit for receiving material sucked into the intake conduit; the intake conduit having a pair of opposite, spaced apart walls extending down to the intake orifice which are shaped and placed for defining the intake orifice as a relatively narrow opening measured along one dimension of the intake orifice and as a wide opening measured along a second dimension transverse to the one dimension;

the shoe attachment being separate from and insertable in the intake orifice; the shoe attachment comprising a pair of opposite, spaced apart, upstanding walls extending along the long dimension of and also into the intake orifice, a bottom surface extending beneath the end of the intake conduit at which the intake orifice is defined, the shoe attachment walls standing up from the bottom surface, whereby those walls and the bottom surface together close off flow through the intake orifice of the suction device; the shoe attachment walls are shaped, are of such material and are normally biased so that those walls engage the inside surfaces of the walls of the intake conduit and this engagement serves as means for retaining the shoe attachment in the intake orifice;

an inlet opening through the bottom surface and defined by and extending between the walls of the shoe attachment and communicating into the intake conduit, wherein the inlet opening is narrower along the same one dimension than the intake orifice for increasing the air speed and/or the suction force at the inlet opening, as compared with the air speed and/or suction force that would be present at the intake orifice were the shoe attachment absent;

a blade located in the space between and spaced from both of the walls of the intake conduit and the blade extending along the long dimension of the inlet opening and dividing the inlet opening into two sections at opposite sides of the blade; the blade being of the same material as and integrally formed in one piece with the shoe attachment; the blade being sufficiently flexible at the shoe attachment and extending such length down beneath the bottom surface of the shoe attachment that the blade may be flexed in one direction against the bottom surface at one side of the inlet opening for closing off one of the two sections of the inlet opening and may also be flexed in the opposite direction against the bottom surface of the shoe attachment at the opposite side of the inlet opening for closing off the other of the two sections of the inlet opening.

2. The shoe attachment of claim 1, wherein the shoe attachment and the bottom surface thereof extend around the periphery of the intake orifice of the suction device.

3. A vacuum cleaner comprising:

a housing, an intake conduit defined in the housing, means for supplying suction force to the intake conduit, and the intake conduit having an end having an intake orifice into which material is sucked by the suction force; means for collecting material sucked through the intake conduit and communicating with the intake conduit; the intake conduit being shaped for defining the intake orifice as a relatively narrow opening measured along one dimension of the intake orifice; and the shoe attachment of claim 1, inserted in the intake orifice.

4. The vacuum cleaner of claim 3, wherein the intake orifice is oriented so that its narrow dimension is along the normal path of movement of the vacuum cleaner during use of the vacuum cleaner.

5. The shoe attachment of claim 1, further comprising a projection on and located beneath the bottom surface of the shoe attachment for raising the inlet opening off a surface to be suctioned; the blade being of a length to extend below the projection, whereby as the shoe attachment is moved along a pathway along the narrow dimension of the inlet opening in one direction, the blade is folded to close off one of the sections of the inlet opening, and as the shoe attachment is moved in the opposite direction, the blade is folded to close off the other section of the inlet opening.

6. The shoe attachment of claim 5, further comprising two of the projections spaced apart from each other at the bottom surface of the shoe attachment for raising the inlet opening off the surface to be suctioned.

7. The shoe attachment of claim 6, wherein the projections each have a respective bottom surface which is curved around the axis of the long dimension of the inlet opening, and the blade length is selected such that the blade extends below the bottom surfaces of the projections.

8. A vacuum cleaner comprising:

a nozzle, an intake conduit defined in the nozzle, means for supplying suction force to the intake conduit, and the intake conduit having an end having an intake orifice into which material is sucked by the suction force; means for collecting material sucked through the intake conduit and communicating with the intake conduit; the intake conduit being shaped for defining the intake orifice as a relatively narrow opening measured along one dimension of the intake orifice; and the shoe attachment of claim 6, inserted in the intake orifice.

* * * * *